US005609372A

United States Patent [19]

Ponelle

[11] Patent Number: 5,609,372

[45] Date of Patent: Mar. 11, 1997

[54] PUSH-PULL LOCK OPERATING DEVICE

[75] Inventor: Viviane Ponelle, Chatillon, France

[73] Assignee: J P M Chauvat S.A., Avermes, France

[21] Appl. No.: 348,202

[22] Filed: Nov. 28, 1994

[51] Int. Cl.[6] ..... E05C 3/04

[52] U.S. Cl. ..... 292/200; 292/336.3

[58] Field of Search ..... 292/200, 336.3, 292/DIG. 27, DIG. 53, 140, 245

[56] References Cited

U.S. PATENT DOCUMENTS

| | | | |
|---|---|---|---|
| 3,046,776 | 7/1962 | Marotto et al. | 292/336.3 |
| 3,264,025 | 8/1966 | Hawes | 292/166 |
| 3,785,686 | 1/1974 | Armstrong | 292/336.3 |
| 3,869,159 | 3/1975 | Eads | 292/336.3 X |
| 4,007,954 | 2/1977 | Erickson | 292/165 |
| 4,101,153 | 7/1978 | Dozier | 292/336.3 X |
| 4,305,612 | 12/1981 | Hunt et al. | 292/336.3 |
| 4,861,083 | 8/1989 | Fish et al. | 292/336.3 X |
| 5,072,977 | 12/1991 | Millman et al. | 292/336.3 |
| 5,085,474 | 2/1992 | Toledo et al. | 292/92 |
| 5,088,778 | 2/1992 | Lin | 292/336.3 |

FOREIGN PATENT DOCUMENTS

| | | |
|---|---|---|
| 0113655 | 4/1987 | European Pat. Off. . |
| 1276497 | 8/1968 | Germany . |
| 2131865 | 6/1984 | United Kingdom . |

*Primary Examiner*—Rodney M. Lindsey
*Assistant Examiner*—Monica E. Millner
*Attorney, Agent, or Firm*—Loeb & Loeb LLP

[57] ABSTRACT

A push or pull type device for operating a lock bolt includes a support attached to a door carrying the lock. This support carries a cam rotatably mounted on a plate and including a square hole for a corresponding cross-section rod to be inserted into the lock to operate the bolt. An actuator member mounted to pivot about a rotation axis substantially parallel to the plate has two spaced lugs whose paths on pivoting lie on either side of the rotation axis of the cam. A handle is an integral part of or is removably mounted on the actuator member and angular play connected with a pre-orientation of the nut is compensated elastically.

7 Claims, 5 Drawing Sheets

PUSH-PULL LOCK OPERATING DEVICE

BACKGROUND OF THE INVENTION

1. Field of the Invention

The present invention concerns a device for operating locks by pushing or pulling an operating member such as a handle accessible to a user.

2. Description of the Prior Art

These operating devices enable a door to be opened by application of a lever arm movement either by pushing the operating member towards the door or by pulling it in the opposite direction.

The present invention relates more particularly to an operating device of this type which can be added to any lock, for example a mortice lock, including a rod, usually of square cross-section, which is rotated to actuate a bolt mounted in the lock.

This square cross-section rod operates the bolt through a nut rotatably mounted in the lock case. The nut actuates the bolt and includes a square hole in which the square cross-section rod is inserted.

These devices are intended in particular to replace the existing operating members, e.g. handles, of locks already inset into the edge of a door and of the kind requiring the user to rotate the member and at the same time to push or pull it to open the door. These operating members are less ergonomically efficient than the push-pull operating devices intended to replace them.

However, in the case of locks to be inset into the edge of a door, for example, a predefined direction of rotation of the square cross-section rod corresponds to a downward tilting movement of the handle operating the rod.

Accordingly, the direction of rotation of the square rod is reversed depending on whether the lock is lefthanded or righthanded on the same side of the door.

To avoid unnecessary multiplication of the number of operating devices required, the devices must be able to operate the locks to which they are fitted independently of the direction of rotation of the square rod, at least for each of the push and pull types.

It is preferable for these devices to be able to operate the locks to which they are fitted independently of the direction of rotation of the square rod and of the mode of operation: push or pull.

In the locks previously mentioned a spring returns the nut to its rest position after it has been actuated by the user by means of the operating member mounted on the square rod.

This spring holds the nut in a rest position such that a conventional handle mounted on the square rod to serve as an operating member is held in a substantially horizontal plane.

To prevent the handle drooping under the horizontal plane the spring when fitted is adapted to coordinate the orientation of the nut with that of the handle so that the latter is oriented in a direction above the horizontal plane at an angle usually between 0° and 7°.

The push or pull devices to be fitted to these locks and adapted to operate these nuts must therefore also provide adequate compensation to allow for this variable "pre-orientation".

The present invention has the following mutually independent objects.

One object of the present invention is to provide an ergonomically efficient push or pull type lock operating device.

Another object of the present invention is to provide a push or pull type lock operating device which is able to operate a lock independently of the direction of rotation of the square rod and therefore of the nut of the lock.

A further object of the present invention is to provide a lock operating device able to operate a lock independently of the direction of rotation of the nut of the lock and of the mode of operation: push or pull.

A still further object of the present invention is to provide a lock operating device able to operate a lock independently of previous angular positioning of the square cross-section orifice in a lock nut.

The objects of the present invention as stated above may also be achieved in combination.

SUMMARY OF THE INVENTION

The present invention consists in a push or pull type device for operating a lock bolt, the device including a support adapted to be attached to a door carrying said lock, said support carrying a cam rotatably mounted on a plate and including a square hole for a corresponding cross-section rod to be inserted into said lock to operate said bolt and an actuator member mounted to pivot about a rotation axis substantially parallel to said plate and having two spaced lugs whose paths on pivoting lie on either side of the rotation axis of said cam.

In a first embodiment of the present invention said actuator member includes a base articulated to said support to pivot said actuator member, which base carries said lugs which extend towards said plate, said base being extended by a handle and said lugs being placed so that on pivoting when said handle is pushed or pulled they move closer to said cam.

Accordingly, the lock operating device can be lefthanded or righthanded and installed on either side of the door, whether it is of the pull type or of the push type.

In another embodiment of the present invention the actuator member includes a pivoting member cooperating with a removable handle, the pivoting member carrying the lugs which extend towards the plate and are disposed so that they move towards each other on pivoting of the cam when the handle is pushed or pulled.

A lock operating device of this kind can be lefthanded or righthanded and installed on the inside or on the outside of the door and can be pulled or pushed.

In other words, the device is entirely reversible.

The features and advantages of the invention will emerge from the following description given by way of example with reference to the appended diagrammatic drawings.

DETAILED DESCRIPTION OF THE PREFERRED EMBODIMENTS

Figure 1:
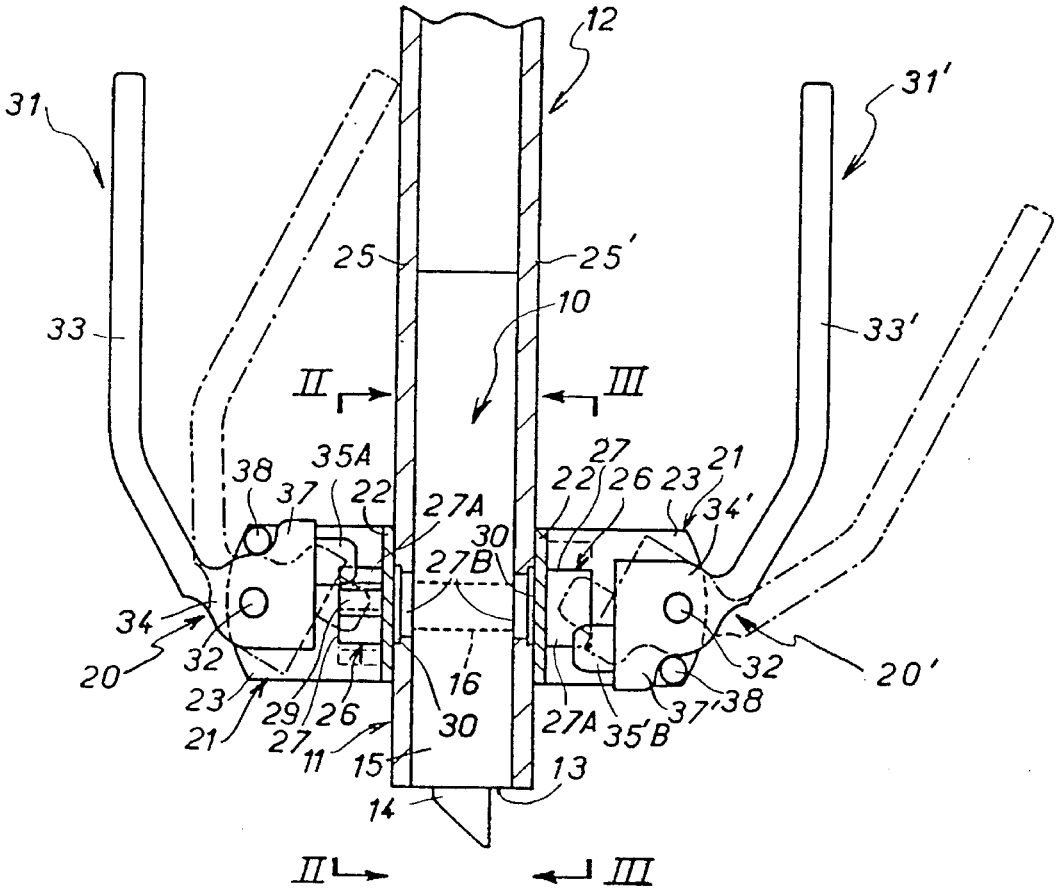
FIG. 1 is a view in horizontal section showing the operating principle of two lock operating devices constituting a first embodiment of the invention, one of which is a push type device and the other of which is a pull type device, the devices being fitted to a lock inset into the edge of a door.
Figure 2:
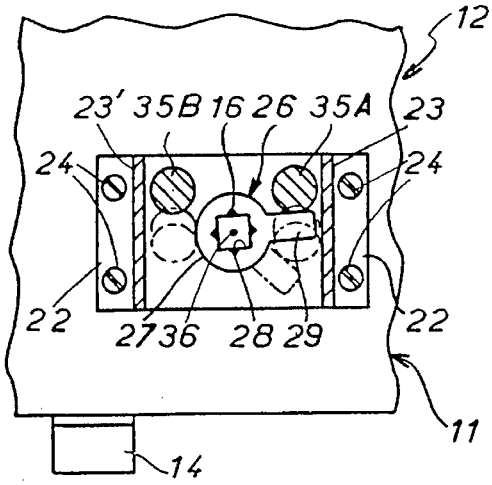
FIG. 2 is a view of the push type device in section on the line II—II in FIG. 1.
Figure 3:
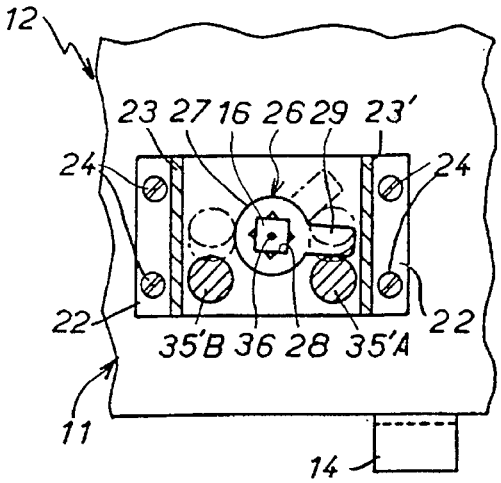
FIG. 3 is a view of the pull type device in section on the line III—III in FIG. 1.

A first embodiment of lock operating device of the invention is described first with reference to FIGS. 1 to 3.

As previously mentioned, the operating devices shown in FIGS. 1 to 3 are fitted to a lock 10 inset into the vertical free edge 11 of a door 12 of which only part is shown.

The horizontal section shown here is a view of the door 12 as seen from below.

When the door 12 is closed its edge 13 rests against a rebate of a jamb of the door frame.

In this position a half-turn bolt 14 of the lock 10 engages in a keeper mounted in the rebate.

The lock 10 is a mortice lock, i.e. it has a generally parallelepiped shape case 15 inset into a mortice cut into the door 12.

The lock 10 includes a square cross-section rod 16 shown in dashed outline in FIG. 1 which is rotated to actuate the half-turn bolt 14.

To this end the rod 16 is inserted in a square hole in a nut rotatable in the case 15 of the lock 10; not visible in FIGS. 1 to 3, this nut rotates to move the bolt 14 in translation.

The case 15 of the lock 10 also contains a nut spring to return the nut to its rest position after it has been rotated by the square rod on use of an operating member by a user.

To this end each device 20 and 20' includes a substantially U-shape support 21. This support is identical in both devices. It has a plate 22 with flanges 23 and 23' on two sides.

Only the flange 23' can be seen in FIGS. 2 and 3. The flanges are perpendicular to the vertical sides of the case 15 of the lock 10.

The supports 21 are attached to the lock 10 by their plates 22.

To this end the plates 22 incorporate holes (not shown in the figures) for screws 24 (see FIGS. 2 and 3) for fixing the supports 21 of the operating devices 20 and 20' to the inside and outside skins 25, 25' of the door 12.

The operating devices 20 and 20' are in this way attached to the lock 10, the case 15 of the lock 10 being inset into the door 12 parallel to the skins 25, 25'.

Any other fixing arrangement can be used.

In accordance with one particularly advantageous feature of the present invention the support 21 carries a cam 26 freely rotatable on the plate 22.

The cam 26 has a cylindrical part 27 incorporating a square hole 28 through which the square cross-section rod 16 is passed when the plate 22 of the support 21 has been attached to the lock 10. The cam 26 is therefore mounted coaxially on the rod 16, as shown in FIGS. 1 to 3.

The hole 28 extends along the axis of the cylindrical part 27, this axis defining the rotation axis of the cam 26.

The cam 26 also carries a finger 29 projecting perpendicularly to the above axis from one end of the cylindrical part 27.

The cam 26 is mounted on the plate 22 so that it is free to rotate in the manner described below and shown schematically in FIG. 1.

The cylindrical part 27 has, lengthwise of its axis, a first part 27A of given outside diameter carrying the finger 29 and a second part 27B with a smaller outside diameter.

The plate 22 has a central circular orifice, not visible in FIGS. 1 to 3, whose diameter is such that only the second part 27B can pass through it.

A circular groove on the second part 27B, not visible in FIGS. 1 to 3, receives a circlip 30.

Accordingly, the cylindrical part 27 is free to rotate relative to the plate 22 but otherwise immobilized on it, the first part 27A and the circlip 30 bearing on respective opposite sides of the plate.

The space occupied by the part 27B when the device 20 or 20' is attached to the door 12 is provided by appropriate drilling of the inside and outside skins 25 and 25' so that the plate 22 is flush with them.

An alternative way to provide this space would be to use a slotted second plate attached to the door 12 to support the plate 22 of the support 21.

In accordance with the invention, the support 21 carries, in addition to the cam 26, an actuator member pivoting about a rotation axis substantially parallel to the plate 22.

In the first embodiment of the invention this is either a push type actuator member 31 or a pull type actuator member 31'.

The actuator member 31 or 31' has a base 34 or 34' articulated to the support 21 to allow pivoting of the actuator member 31 or 31'. The base 34 or 34' is extended by a handle 33 or 33' and carries two spaced lugs 35A, 35B or 35'A or 35'B whose paths on pivoting are on opposite sides of the rotation axis 36 of the cam 26.

The lugs 35A, 35B or 35'A, 35'B project from the base 34 or 34' towards each of the plates 22 and are disposed on the base 34 or 34' in such a way that they move towards the cams 26 on pivoting when the handle 33 of the actuator member 31 is pushed or the handle 33' of the actuator member 31' is pulled.

The first embodiment of the invention therefore provides a push type actuator member 31 and a pull type actuator member 31' which are different from each other.

To be more precise, each of the pairs of lugs 35A, 35B and 35'A, 35'B is parallel to the rotation axis 36 of its cam 26 which is oriented on the square rod 16 so that each finger 29 is in contact with one of the two lugs of each pair 35A, 35B and 35'A, 35'B depending on the direction in which the square cross-section rod 16 is required to rotate.

The finger 29 is therefore oriented substantially vertically downwards for the push type operating device 20 and substantially vertically upwards for the pull type operating device 20'.

Accordingly, on moving from the rest position shown in full line in FIGS. 1 to 3 to the actuated position shown in chain-dotted line in FIGS. 1 to 3, upon pushing on the handle 33 or pulling on the handle 33', the corresponding finger 29 is actuated to cause rotation of the corresponding cam 26.

This rotation causes the rod 16 to rotate in the same direction, which releases the bolt 14 from the keeper.

The nut is returned to its rest position by the previously mentioned nut spring.

With reference to the deposition of the lugs, in the case of the push type member 31 the pair of lugs 35A, 35B and the handle 33 are disposed on the same side of a plane containing the rotation axis of the base 34 and parallel to the direction of the lugs 35A, 35B.

Similarly, the pair of lugs 35'A, 35'B and the handle 33' of the pull type member 31' are on opposite sides of a similar plane.

The rotation axis of the base 34 or 34' is that of the corresponding actuator member 31 or 31'.

The latter is shown in FIGS. 1 to 3 by a bore in the base 34 or 34' through which a cylindrical spindle 32 passes.

The ends of this spindle 32 engage in holes in the flanges 23, 23' at the sides of the plate 22. The spindle is removable, in the manner familiar to the person skilled in the art, to enable removal of the actuator member 31 or 31' from the support 21.

The spindle 32 is mounted between the flanges 23, 23' in a plane substantially parallel to the plate 22 so that the handle 33 or 33' can be pushed or pulled according to whether the operating device is a push type device 20 or a pull type device 20'.

The orientation of this spindle 32 in this plane is the same as that of the finger 29 of the cam 26, i.e. vertical.

Note that only the placement of the lugs on the base of each of the actuator members 31 or 31' changes in this case.

The other components of the push type operating device 20 or pull type operating device 20', including those described hereinafter, are identical in all respects.

In accordance with another particularly advantageous feature of the present invention, the support 21, whether intended for a push type lock operating device 20 or a pull type lock operating device 20', further includes an angular play compensating elastic abutment against which the corresponding base 34 or 34' bears in the rest position and one of the lugs 35A, 35B, 35'A or 35'B of the base 34, 34' bears on the cam 26, in this instance on the finger 29 of the cam 26.

In this embodiment the abutment is in the form of a cellular plastics material spindle 38 with its ends engaged in the flanges 23, 23' of the support 21.

In the rest position a shoulder 37, 37' on each base 34, 34' bears against the corresponding spindle 38.

The cellular plastics material is expanded polyurethane, for example.

The spindle 38 is disposed so that when the finger 29 in contact with one of the lugs of the base 34 or 34' is oriented in a direction corresponding, in the rest position, to a maximal pre-orientation of the nut or of the square rod 16, and therefore of the cam 26, the shoulder 37 or 37' of the base 34 or 34' compresses the elastic material of the spindle 38.

Accordingly, regardless of the pre-orientation of the nut, the elasticity of the spindle 38 compensates the angular play caused by this pre-orientation and holds one lug of the pair 35A, 35B or 35'A, 35'B against the corresponding finger 29.

This will continue to be the case as the nut spring ages.

As an alternative to the above, the angular play compensating elastic abutment can be provided by a spindle similar to the spindle 38 and with its ends engaged with the flanges 23, 23', but with the base carrying a cellular plastics material shoulder which in the rest position bears against the spindle, while one of the lugs 35A, 35B, 35'A, 35'B bears on the cam 26 or the finger 29 of the cam 26. The cellular plastics material can be carried by the shoulders 37, 37' of the bases 34, 34', for example.

If the support 21 is replaced with a casing, the cellular plastics material should could also abut against one side of the casing, rather than the corresponding spindle.

The first embodiment of operating device of the invention can be mounted in the following manner.

After determining the mode of operation (push or pull) for a given side of the door, the corresponding actuator member 31 or 31' and its orientation are chosen.

The support 21 is then attached to the member 25, 25' of the door 12 ensuring that the finger 29 of the cam 26 is oriented correctly before attaching the support 21 to the door skin 25, 25' and, at the same time, mounting the cam 26 on the square rod 16.

The finger 29 is disposed so that it is in contact with one lug of the actuator member 31 or 31' which is next mounted to pivot on the support 21, by means of the cylindrical spindle 32.

It must be oriented according to the orientation of the rotation axis of the actuator member 31 or 31' and according to the direction in which the square rod 16 is required to rotate.

During the attachment of the support 21 it may be necessary to cut the square rod 16 to length or to drill the door 12 to accommodate the part 27B of the cam 26.

The support 21 must also be attached to provide the angular play compensating elastic abutment when the actuator member 31 or 31' is mounted.

A second embodiment of the present invention is described next with reference to FIGS. 4 to 13.

This embodiment of the lock operating device is totally reversible, i.e. it can be of the push type or the pull type, lefthanded or righthanded, on the inside or on the outside of the door.

Figures 4, 5, 6, 7, 8, 9:
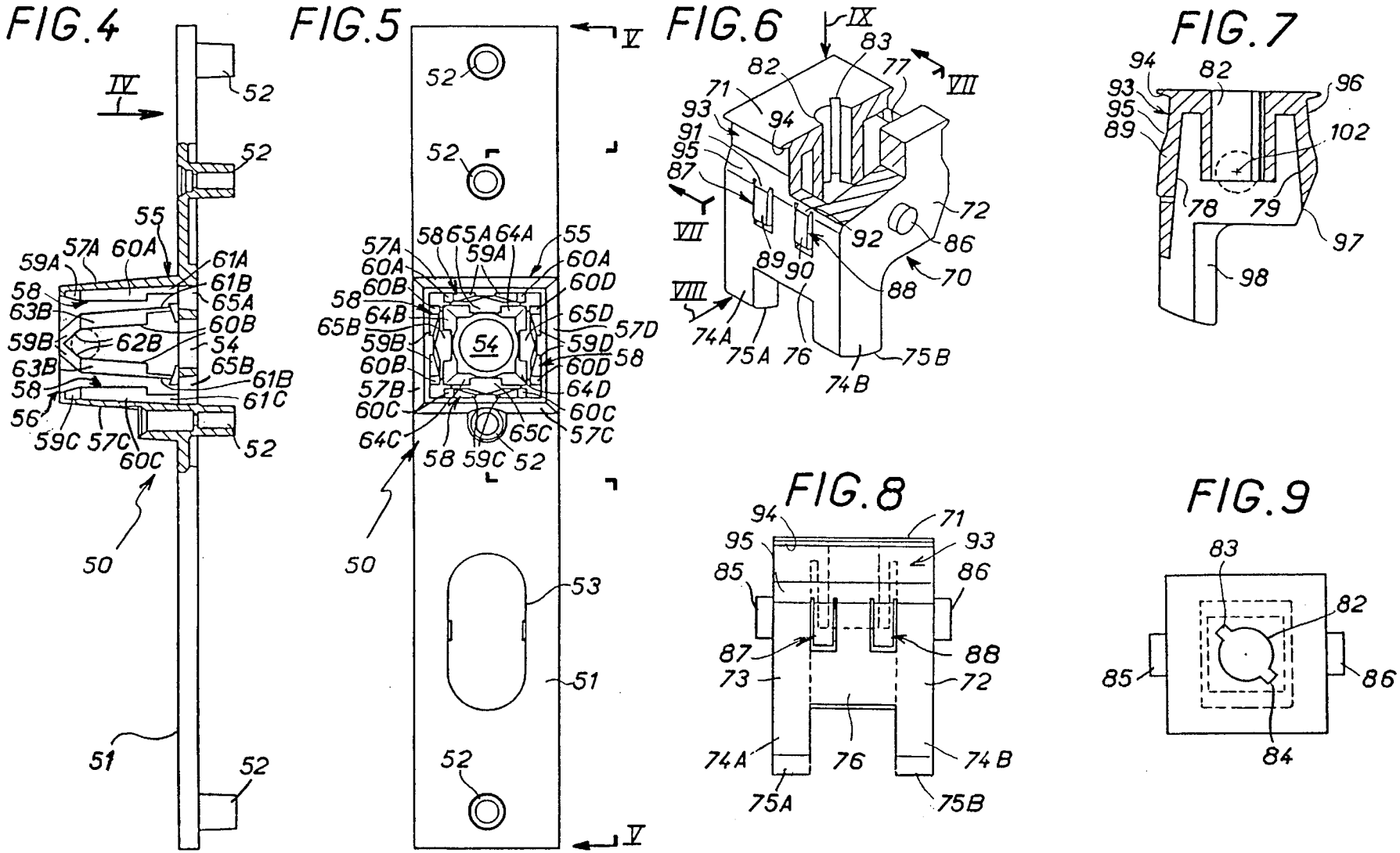
FIG. 4 is a partially sectional side view of a support for a second embodiment of lock operating device of the invention.
FIG. 5 is a view of this support as seen in the direction of the arrow IV in FIG. 4.
FIG. 6 is a partially cut-away three-quarter front perspective view of a pivoting member of the second embodiment of lock operating device of the invention.
FIG. 7 is a view of this member in section on the line VII—VII in FIG. 6.
FIG. 8 is a diagrammatic view of this member as seen in the direction of the arrow VIII in FIG. 6.
FIG. 9 is a diagrammatic view of this member as seen in the direction of the arrow IX in FIG. 6.

Referring to FIGS. 4 and 5, the device includes a support 50 including a plate 51.

Along the longitudinal center line of the rectangular plate 51 are three milled bosses 52 projecting from one side of the plate.

These bosses are for fixing means such as screws (not shown) which, after a door (not shown) is drilled accordingly, are used to attach the plate 51 to the door with the side on which the bosses 52 project against the door.

The plate 51 also includes a cylinder centering member 53 in its lower half through which a lock cylinder (not shown) passes.

The upper half of the plate 51 includes a circular orifice 54 through which a cam (not shown) passes.

As described below with reference to FIGS. 10 and 11, the cam is mounted on the plate 51 through the orifice 54 so that it can rotate freely.

The orifice 54 is surrounded by a receptacle 55 extending the plate 51 of the support 50 on the side opposite that from which the bosses 52 project.

The receptacle 55 encloses the cam when the latter is mounted on the plate 51 and has an opening 56 in it which has a square cross-section in a plane parallel to the plate 51.

To this end the opening 56 is delimited by four elastically deformable walls 57A–57D which converge in the direction from the plate 51 towards the opening 56.

Where the plate 51 and the receptacle 55 merge, the side length of the receptacle 55 is equal to the width of the plate 51.

Each of the walls 57A–57D has projections 58 on its inside surface.

These projections 58 include projections defining retaining abutments in the form of pairs of forcing ramps 59A–59D diverging in a V-shape from the opening 56 in the middle of each of the inside surfaces of the walls 57A–57D towards the plate 51.

The angle of the V-shape is around 90°.

The pairs of ramps 59A–59D are also inclined towards the wall opposite the wall carrying them.

Accordingly, over a first part of the corresponding wall surface the outermost edges of each of these pairs of ramps 59A–59D define a half-pyramid shape space truncated in the longitudinal direction.

Each ramp of the pairs of forcing ramps 59A–59D is extended by a rib the same width and thickness as the ramp. The pairs of ribs 60A–60D formed in this way diverge towards the plate over a second part of the inside surface of each of the walls 57A–57D.

Finally, pairs of longitudinal fillets 61A–61D narrower and thinner than the ribs 60A–60D extend the latter over the remaining part of the wall surface, so linking the ribs 60A–60D to the plate 51.

The ribs 60A–60D and the fillets 61A–61D are part of the projections 58.

The inside edges of each V-shape (only the pair of edges of the pair of ramps 59B is specifically identified (by the reference number 62B in the figures) delimit a volume to house a journal of a pivoting member described below and form abutments to retain this journal.

The edges 62B can be complemented by the inside edges (no reference number) of each of the pairs of ribs 60A–60D, i.e. the inside edges extending the inside edges of the V-shape (reference number 62B).

The longitudinal fillets 61A–61D extend the ribs 60A–60D at their outside edges which extend the outside edges of the V-shape (no reference number) formed by the pairs of ramps 59A–59D.

The plate 51 also has curved surface projections 64A–64D adapted to cooperate with the front end of lugs of the pivoting member 70 previously mentioned, to guide pivoting of the member 70.

These projections advantageously act also as abutments for these lugs.

The curved surface projections include four guide ribs 64A–64D projecting from the plate 51 and each parallel to a respective wall 57A–57D of the receptacle 55.

Each guide rib 64A–64D is disposed between the circular orifice 54 and a plane (no reference number) containing the edges 63A–63D of the ribs 60A–60D facing the wall opposite the wall carrying the latter ribs 60A–60D.

The subscripts A through D of the reference numbers relate to a respective one of the four walls 57A–57D of the receptacle 55. To clarify the figures and because of the viewing angle or section plane, some of the reference numbers mentioned are not shown in all the figures.

The side of the guide ribs 64A–64D facing the opening 56 has a longitudinal circular arc shape guide track.

The four ribs 64A–64D are contiguous at their ends.

Each rib 64A–64D has substantially at its center a notch facing the corresponding receptacle wall 57A–57D.

Each of these notches (no reference number) extends part of one of four openings 65A–65D formed in the plate 51 for reasons connected with the casting technology.

The support 50 as so far described with reference to FIGS. 4 and 5 is cast in one piece. Note that the arrows V—V in FIG. 5 represent the section plane for the sectioned part of FIG. 4.

The support 50 is adapted to carry a pivoting member 70 described with particular reference to FIGS. 6 through 9.

The pivoting member 70 has a square cross-section back 71.

Two support walls 72, 73 on the back 71 extend the width of two opposite sides.

The support walls 72, 73 are thicker than the back 71 and are perpendicular to the back 71 (arrow IX in FIG. 6).

Two lugs 74A, 74B extend the respective support walls 72, 73 in this perpendicular direction, within their thickness.

The two lugs 74A, 74B are on the same side.

Their free ends 75A, 75B are curved with the same radius of curvature as the guide tracks on the ribs 64A–64D of the support 50 previously described.

Two thin walls 76, 77 joins together the support walls 72, 73, each running along one of the other two sides of the back 71.

The thickness of the thin walls 76, 77 is substantially equal to that of the back 71.

The thin wall 74 on the same side as the lugs 74A, 74B is longer in the previously mentioned perpendicular direction (arrow IX) than the other thin wall 77 on the opposite side. It therefore joins together the lugs 74A, 74B over part of their length, i.e. their dimension in the previously mentioned perpendicular direction.

The pivoting member 70 also includes a circular chimney 82 projecting perpendicularly to the back 71, substantially in the middle of the latter.

The chimney 82 extends in the direction of the lugs 74A, 74B between the support walls 72, 73 and the thin walls 76, 77.

Diametrally opposed grooves 83, 84 in the wall of the chimney 82 open into the latter.

The ribs 83, 84 are perpendicular to the back 71.

The chimney 82 with the grooves 83, 84 forms a bore adapted to receive a handle (not shown), for example a handle of the type described below with reference to FIGS. 14 to 16.

In this way the removable handle can cooperate with the pivoting member 70 to cause the latter to pivot by pushing or pulling on the handle.

To allow this pivoting movement, described in more detail below, two aligned journals 85, 86 project from the pivoting member 70, one on each of the support walls 72, 73.

The rotation axis defined by the journals 85, 86 is parallel to the back 71.

Ignoring the lugs 74A, 74B, the journals 85, 86 are substantially in the middle of the respective support wall 72, 73.

The pivoting member 70 also includes two spaced elastic tongues 87, 88 disposed laterally of the journals 85, 86 and extending longitudinally in the same direction as the lugs 74A, 74B.

Each tongue 87, 88 is formed by a U-shape cut-out through the thin wall 76 on the same side as the lugs 74A, 74B.

The pivoting member 70 being molded in one piece, the use of an appropriate plastics material confers the necessary elasticity on the tongues 87, 88 of the pivoting member 70.

The tongues 87, 88 are attached to the thin wall 76 at the end nearest the back 71, which end is parallel to the back 71.

Each tongue 87, 88 has a boss 89, 90 covering all of its surface so that the tongues 87, 88 project out of the pivoting member 70.

On the same side as the lugs 74A, 74B a groove 93 extends across the width of the corresponding side of the back 71, between the back 71 and the attachment ends 91, 92 of the tongues 87, 88.

The groove 93 occupies virtually all of the thickness of the back 71 and its lateral surfaces 94, 95 are inclined. The groove 93 has dimensions such that it mates with the complementary shapes of the receptacle 55 after pivoting of the pivoting member 70 as described below with reference to FIG. 11.

A groove 96 with the same dimensions as the groove 93 extends symmetrically to the groove 93 at the end of the thin wall 77 on the side opposite the lugs 74A, 74B.

The end of the thin wall 77 on the side opposite the lugs 74A, 74B is formed with a bevel 97 towards the thin wall 76 on the same side as the lugs 74A, 74B, at the end opposite the back 71'.

The angle and the length of the bevel 97 are such that the pivoting member 70 bears simultaneously with the groove 93 and the bevel 97 on the facing parts of the projections 58 in the receptacle 55, after pivoting of the pivoting member 70 on the support 50, as described below with reference to FIG. 11.

The lugs 74A, 74B have a rectangular cross-section with a bevel on the side facing the opposite thin wall 77 in a plane parallel to the back 71.

Figure 13:
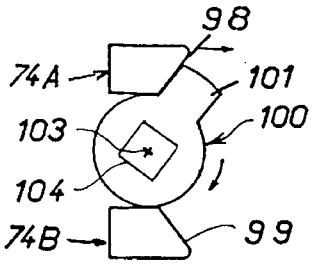
FIGS. 12 and 13 are diagrammatic views showing the positions of a cam and of the pivoting member corresponding to FIGS. 10 and 11, respectively.
Figure 12:
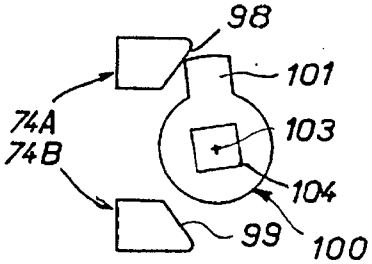

The lugs 74A, 74B are bevelled so that imaginary lines extending the inclined sides 98, 99 of the respective lugs 74A, 74B towards the thin walls 76 linking them cross over (see FIGS. 12 and 13).

The support 50 and the pivoting member (actuator member) 70 have shapes and dimensions such that they cooperate in the manner described below with reference to FIGS. 10 to 13.

Figure 11:
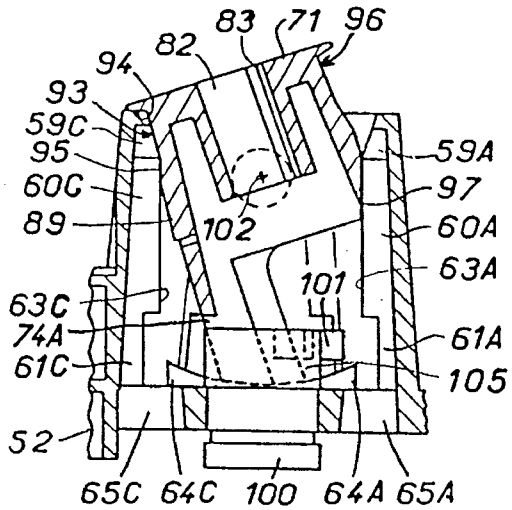
FIGS. 10 and 11 are partial views in section of the second embodiment of lock operating device of the invention, respectively in a rest position and an actuation position.
Figure 10:
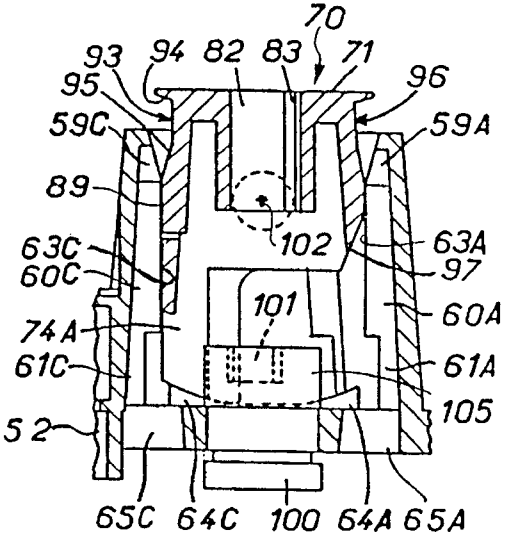

FIGS. 10 and 11 are sectioned views of a pivoting member 70 nested in the receptacle 55 of a support 21 like that described with reference to FIGS. 4 to 9.

FIGS. 10 and 11 respectively show a rest position and an actuated position of the pivoting member 70.

Of the support 21, only the receptacle 55 and the major part of the plate 51 are shown.

A cam 100 is carried by the plate 51 of the support 50, through the circular orifice 54.

The cam 100 is free to rotate on the plate 51 in the manner already described for the first embodiment of the invention and thus no further comment is necessary.

The cam 100 has the same construction as the cam 26 described for the first embodiment of the invention except that, unlike the finger 29 of the cam 26, the finger 101 does not occupy all of the length of the cylindrical cam part 105 projecting from the plate 51 into the receptacle 55.

The finger 101 occupies only the end of the cylindrical part 105 of the cam 100, so leaving a gap for the curved surface projections 64A–64D.

The pivoting member 70 is forcibly nested in the receptacle 55 of the support 50.

This is possible because the walls 57A–57D of the receptacle 55 are elastically deformable.

During this forcible nesting, the journals 85, 86 are initially guided by two opposed pairs of forcing ramps 59A–59D. Once nested, they are retained by the inside edges 62A–62D of the ramps 59A–59D.

The forcing ramps 59A–59D therefore serve as projections defining retaining abutments for the pivoting member 70 after forcible nesting of the latter.

To this end, they are complemented by the inside edges of the ribs 60A–60D extending the forcing ramps 59A–59D as shown, for example, by the circular area (no reference number) in dashed outline in FIG. 4 representing the position of a journal.

The projections defining retaining abutments 59A–59D thus also form bearings in which the journals rotate to enable pivoting of the pivoting member (actuator member) 70.

Depending on which pair of opposed projections 59A–59D is chosen, the rotation axis (reference number 102 in FIGS. 10 and 11), which is parallel to the plate 51, can be oriented vertically or horizontally.

This axis is defined by the axis of the journals 85, 86.

The orientation is horizontal in this example.

The lugs 74A, 74B carried by the pivoting member 70 also extend towards the plate 51, their paths on pivoting lying one on each side of the rotation axis 104 of the cam 100.

The lugs 74A, 74B can be placed parallel to any of the four walls 57A–57D, defining four different mutually orthogonal positions of the pairs of lugs 74A–74B.

The finger 101 on the cam 100 can also be oriented towards any of the walls 57A–57D.

Accordingly, the lock operating device with the support 50 carrying the cam 100 and the actuator member 70 is totally reversible.

Pivoting of the pivoting member 70 from the FIG. 10 position to the FIG. 11 position about the rotation axis 102 moves the lugs 74A, 74B closer to the finger 101 of the cam 100 with the result that one of the two lugs 74A, 74B rotates the cam about its rotation axis 103 (its inclined side 98, 99 is in contact with the finger 101, as shown in FIGS. 12 and 13). FIGS. 12 and 13 are schematic views of the cam 100 and the lugs 74A, 74B in their FIG. 10 and 11 positions, respectively.

When the support 51 is attached to a door (not shown) the cam 100 is simultaneously attached to a square rod (not shown) inserted in a lock (not shown) through a square cross-section hole 104 to actuate a bolt.

On rotation of the cam 100 the square rod is also rotated, actuating the bolt of the lock.

In the rest position each elastic tongue 87, 88 bears on a respective edge 63A, 63D of the pair of ribs 60A–60D facing the wall 57A–57D opposite the wall 57A–57D carrying the latter pair of ribs 60A–60D.

Thus, at rest, depending on the pre-orientation of the lock nut, the finger 101 of the cam compresses the tongues 87, 88 to a greater or lesser degree against the edges 63A–63D of the corresponding pair of ribs 60A–60D.

The edges 63A–63D are those of the ribs 60A–60D at 90° to the projections defining retaining abutments 59A–59D for the journals 85, 86 of the pivoting member 70.

In the rest position (FIG. 10) part of the surface of the pivoting member 70 enters the groove 96 and the bevel 97 also bears on edges 63A–63D of the same type as those on which the tongues 87, 88 on the opposite side bear.

Because of the elasticity of the tongues 87, 88 the angular play caused by the pre-orientation of the lock nut in the rest position is compensated.

In the actuation position (FIG. 11) the groove 93 and the bevel 97 constitute end of travel abutments for the pivoting member 70.

The pivoting member 70 is actuated by pushing or pulling on a handle (not shown) received in the bore of the chimney 82.

Figure 14:
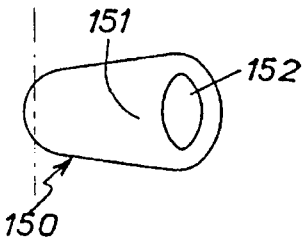
FIG. 14 is an elevation view of a pull type handle of the invention.
Figure 16:
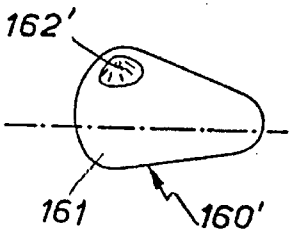
FIGS. 15 and 16 are elevation views of a lefthanded push type handle and a righthanded push type handle of the invention, respectively.
Figure 15:
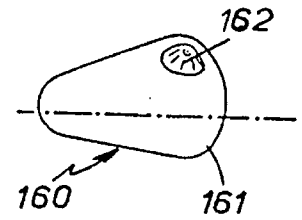

For complete reversibility of the second embodiment of lock operating device of the invention the ergonomically efficient handles described next with reference to FIGS. 14 through 16 are advantageously used.

The handle 150 shown in FIG. 14 is a pull handle. The rotation axis of the pivoting member 70, shown in chain-dotted line, is vertical in this example.

A horizontal position of the latter axis can also be used, with the handle 150 extending upwards or downwards.

The means for mounting the handle on the bore 82 of the pivoting member 70 are not shown. The handle can be lefthanded or righthanded.

It includes towards its free end a wider part 151 in which is a recess 152 for the user to grasp the handle 150 by.

FIGS. 15 and 16 respectively show a lefthanded push handle 160 and a righthanded push handle 160'.

Each incorporates towards its free end a solid wider part 161, 161'. This solid wider part 161, 161' carries a protuberance 162, 162' near the free end, at a distance from the rotation axis of the pivoting member 70 (shown in chain-dotted line).

Accordingly, pushing with the palm of the hand at the location of the protuberance 162, 162' rotates the handle 160, 160' and therefore the actuator member 70, on which it can be mounted in a manner that is not shown in FIGS. 15 and 16.

The handles as described can extend the base 34, 34' in the first embodiment of the invention or be removably attached to the pivoting member 70 and the chimney 82 in which it is received in the second embodiment of the invention.

The square rod can be provided with translation retaining means of the type familiar to the person skilled in the art.

Figure 17:
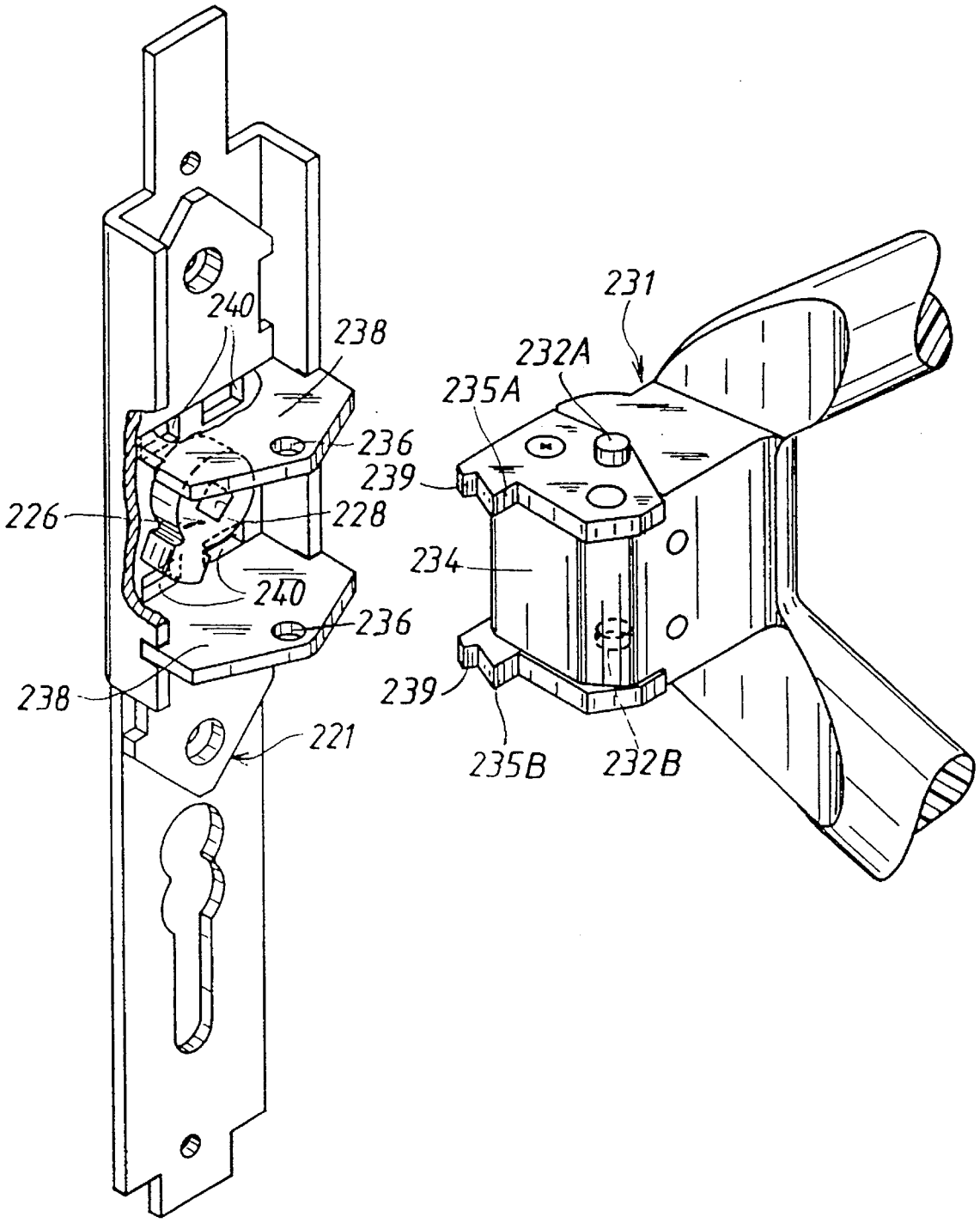
FIG. 17 is a cut-away partial perspective view of another embodiment of operating device of the invention.
Figure 18:
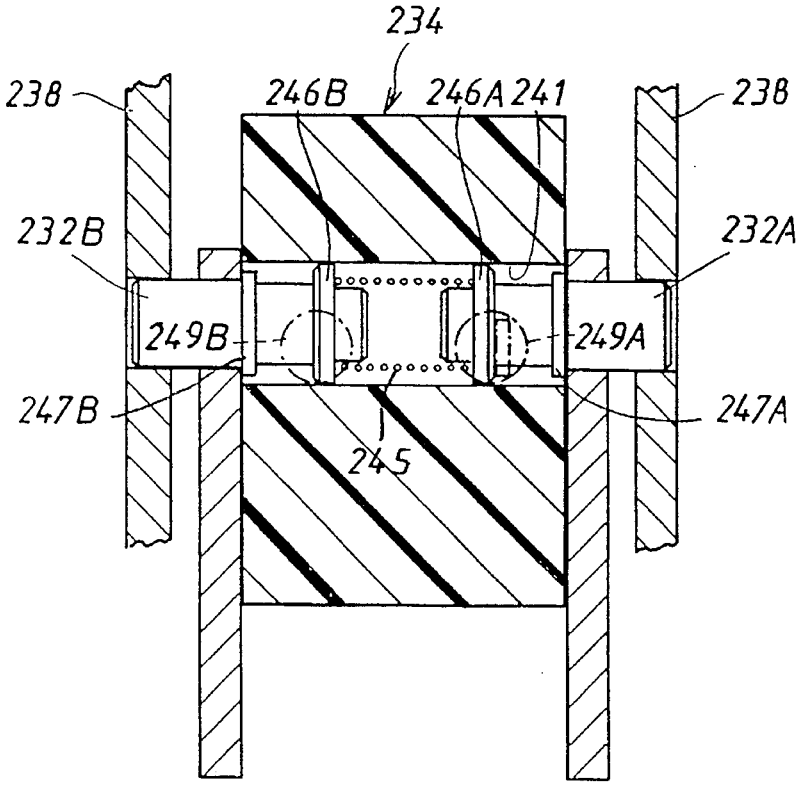
FIGS. 18 and 19 are views in section of the base of the device from FIG. 17 in two different positions, showing the mounting and the demounting of the actuator member.
Figure 19:
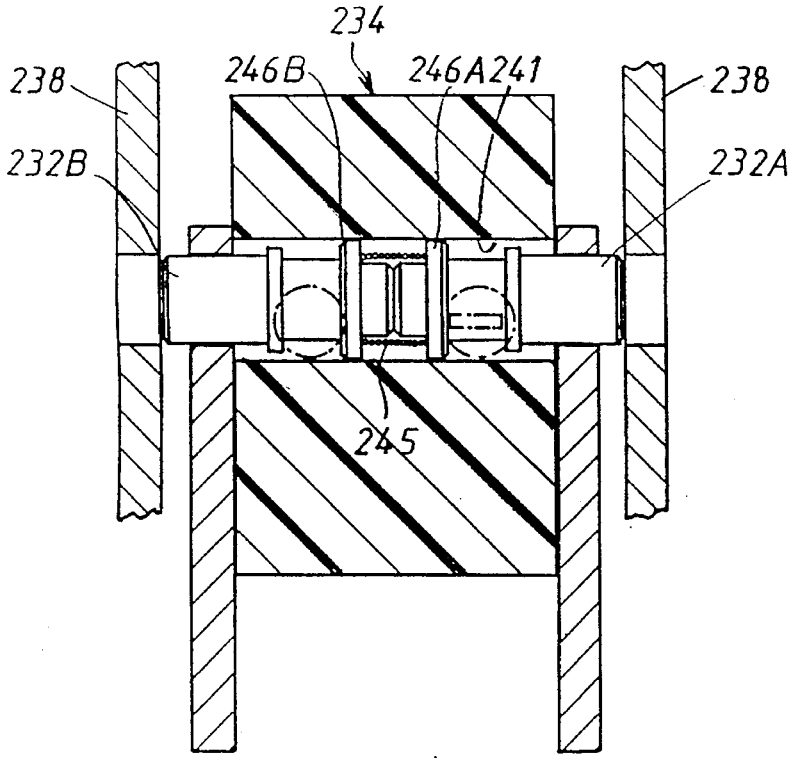

The embodiment of the invention shown in FIGS. 17 through 19 includes a support plate 221 adapted to be fixed to the door; this plate carries a cam 226 which is free to rotate. The cam has a square hole 228 through which a corresponding cross-section rod (not shown) is inserted into the lock for operating the bolt. The actuator member 231 forming a handle is mounted to pivot about a rotation axis parallel to the plate, defined by two journals 232A, 232B. The latter project laterally from a base 234 of the actuator member which includes two lugs 235A, 235B whose paths on pivoting extend on either side of the rotation axis of the cam 226. The journals engage in respective aligned holes 236 in two lateral flanges 238 of said support plate. The plate is adapted to receive a cover (not shown). The cam is mounted between the two lateral flanges 238 on which the base 234 articulates. The cam pivots facing four rectangular openings 240 in the wall of said plate. For each mounting position two of these openings 240 constitute end of travel abutments for the lugs 235A, 235B. The presence of four openings arranged in this way caters for all the mounting positions previously mentioned, in combination with the pre-positioning of the cam relative to the lugs. The latter are formed in metal plates fixed to the ends of said base. They include notches 239 shaped to cooperate abutment-fashion with the edges of the corresponding openings 240. Also, the base forms a casing 241 accommodating the journals 232A, 232B which are independent of each other, although they are aligned axially. Each journal is mobile axially in the casing and urged outwards by a compression spring 245 accommodated in said casing between respective flanges 246A, 246B of the two journals. Each journal also has an abutment flange 247A, 247B pressed against the inside wall of the casing 241 by the spring 245.

Each flange 246A, 246B faces a respective hole 249A, 249B in the casing. By inserting a tool such as a screwdriver or the like into each hole it is possible to separate the flanges and withdraw the journals (FIG. 19). The actuator member can therefore be demounted without removing the cover which conceals the support plate.

The operating devices of the invention described herein as attached to a lock operable from both sides can be attached to a lock operable from one side only, such as a lock for a cupboard door, for example.

There is claimed:

1. Push or pull type device for operating a lock bolt, the device including a support adapted to be attached to a door carrying said lock, said support carrying a cam rotatably mounted on a plate and including a square hole for a corresponding cross-section rod to be inserted into said lock to operate said bolt and an actuator member mounted to pivot about a rotation axis substantially parallel to said plate and having two spaced lugs whose paths on pivoting lie on either side of the rotation axis of said cam, wherein said spaced lugs pivot about the rotation axis and one of said spaced lugs is dimensioned and positioned to contact said cam during pivoting of said actuator member.

2. Device according to claim 1 wherein said actuator member includes a base articulated to said support to pivot said actuator member, which base carries said lugs which extend towards said plate, said base being extended by a handle and said lugs being placed so that on pivoting when said handle is pushed or pulled they move closer to said cam.

3. Push or pull type device for operating a lock bolt, the device including a support adapted to be attached to a door carrying said lock, said support carrying a cam rotatably mounted on a plate and including a square hole for a corresponding cross-section rod to be inserted into said lock to operate said bolt and an actuator member mounted to pivot about a rotation axis substantially parallel to said plate and having two spaced lugs whose paths on pivoting lie on either side of the rotation axis of said cam, wherein said cam has a cylindrical part including said square hole extending along the axis of said cylindrical part which defines the rotation axis of said cam and a finger projecting from said cylindrical part perpendicularly to said axis of said cylindrical part and said spaced lugs pivot about the rotation axis and one of said spaced lugs is dimensioned and positioned to contact said finger during pivoting of said actuator member.

4. Operating device according to claim 1 wherein said actuator member has a base housing two aligned journals adapted to engage in respective holes in two lateral flanges of a support plate, said journals being retractable axially in said base for demounting said actuator member.

5. Device according to claim 4 wherein said base houses at least one spring which urges said journals towards the outside of said base.

6. Device according to claim 5 wherein each journal has a flange facing a hole in said base enabling retraction of said journal into the latter.

7. Push or pull type device for operating a lock bolt, the device including a support adapted to be attached to a door carrying said lock, said support carrying a cam rotatably mounted on a plate and including a square hole for a corresponding cross-section rod to be inserted into said lock to operate said bolt and an actuator member mounted to pivot about a rotation axis substantially parallel to said plate and having two spaced lugs whose paths on pivoting lie on either side of the rotation axis of said cam, wherein said actuator member has a base housing two aligned journals adapted to engage in respective holes in two lateral flanges of a support plate, said journals being retractable axially in said base for demounting said actuator member, said base houses at least one spring which urges said journals towards the outside of said base, each journal has a flange facing a hole in said base enabling retraction of said journal into the latter, and said plate is provided with openings having edges defining abutment surfaces and each of said lugs carries a formation defining a notch engaging in a respective opening to cooperate with a respective abutment surface to define an end of travel position of said actuator.

* * * * *